United States Patent [19]

Gavenonis

[11] 4,381,915

[45] May 3, 1983

[54] FILAMENT-TYPE LAMP PRIMER AND FABRICATION PROCESS

[75] Inventor: Thomas L. Gavenonis, Montoursville, Pa.

[73] Assignee: GTE Products Corporation, Stamford, Conn.

[21] Appl. No.: 247,978

[22] Filed: Mar. 27, 1981

[51] Int. Cl.[3] ..... F21K 5/00

[52] U.S. Cl. ..... 431/362; 445/33

[58] Field of Search ..... 431/361, 362; 29/25.16

[56] References Cited

U.S. PATENT DOCUMENTS 3,645,663 2/1972 Shaffer ..... 431/361
4,302,182 11/1981 Shaffer ..... 431/362
4,314,394 2/1982 Armstrong et al. ..... 431/362
4,315,733 2/1982 Bouchard et al. ..... 431/362

*Primary Examiner*—Edward G. Favors
*Attorney, Agent, or Firm*—Thomas H. Buffton

[57] ABSTRACT

A filamentary-type photoflash lamp suitable for use with a relatively low voltage high current power source includes a glass envelope with a shredded metal fill, a pair of leads interconnected by a filament wire and a primer having percussively-ignitable and powdered combustible incandescible material on the leads with the primer material responsive to heat generated by the filament wire. A process for fabricating the above-described photoflash lamp is also provided as well as a primer material composition.

14 Claims, 2 Drawing Figures

FILAMENT-TYPE LAMP PRIMER AND FABRICATION PROCESS

TECHNICAL FIELD

This invention relates to filament-type photoflash lamps and a process for fabricating such lamps and more particularly to filament-type photoflash lamps utilizing a rapid ignition primer and a process for fabricating filament-type photoflash lamps which includes the provision of a rapid ignition primer.

BACKGROUND ART

Generally, one of the numerous ways of categorizing photoflash lamps is those which are electrically activated and those which are percussively activated. Ordinarily, the electrically activated photoflash lamps are of the filamentary type wherein a pair of electrically conductive leads are sealed in a glass envelope with a filament wire interconnecting the electrically conductive leads within the envelope. A primer material is applied to one or both of the conductive leads within the envelope and contiguous with the filament wire. In operation, a relatively low voltage high current source, as for example a voltage of 10.0-volts or less and a current of several hundred milliamperes, is coupled to the electrically conductive leads external to the envelope. This potential source causes the filament wire, usually tungsten, to melt and ignite the primer material affixed to the leads and, in turn, expels burning particles into a shredded fill within the envelope which produces the actinic output of the flashlamp.

On the other hand, the percussively activated flashlamp includes an anvil which is in contact with a primer material especially responsive to any movement thereof to provide burning particles suitable for igniting the shredded fill within the envelope. In operation, a striker activates the anvil which, in turn, causes movement of the primer material in an amount sufficient to cause expulsion of burning particles and ignition of the shredded fill.

Additionally, electrically-activated flashlamps are available wherein a pair of electrically conductive leads are embedded in a glass envelope and a primer material is disposed immediately adjacent one or more of the conductive leads interiorly of the envelope. In operation, a relatively high voltage, anywhere from several hundred to a thousand or more volts at very low currents, is applied to the conductive leads and, in turn, to the primer material. Thereupon, the primer material is activated and ignites the shredded fill within the envelope.

In the past, it was not uncommon to utilize a camera providing a relatively low voltage output in conjunction with a filament-type flashlamp. In such combinations it was also not uncommon to employ a so-called "M-Sync" type operation wherein power was applied to the flashlamp prior to the activation of the camera shutter. As a result, there was sufficient time for the flashlamp to provide the desired actinic output during the period of shutter activation. In other words, activation of the flashlamps 15 to 20 msecs. prior to activation of the camera shutter compensated for the relatively slow reaction of the flashlamp as compared with the activation of the camera shutter.

However, recent advances in films and cameras have resulted in the so-called "X-Sync" type operation wherein activation of the flashlamp and the camera shutter occurs substantially simultaneously. As a result, it was found that difficulties were encountered when utilizing a filament-type flashlamp with an "X-Sync" type camera having a relatively low voltage source.

More specifically, it has been found that the dark time or the time between energization of the filament and the initiation of actinic output from the flashlamp is a problem when presently known low voltage filament-type flashlamps are utilized with an "X-Sync" type camera. Since the filament does not begin to melt or burn immediately upon application of current but rather gradually heats and then burns and the fact that the primer material is not activated until the filament melts and reaches the primer material causing expulsion of burning particles toward the shredded fill material, the resultant appearance of the actinic output of the flashlamp is unduly delayed as compared with the camera shutter speed. As a result, the camera shutter could be operational prior to the provision of a maximum actinic output from the flashlamp.

Actual measurements of available filament-type flashlamps indicated a dark time in the range of about 3.0 to 3.5 msecs. However, it has been found that a reduction in this dark time period, and consequently, a more rapid appearance of the peak light output of the filament-type flashlamp, would be advantageous when an "X-synchronized" camera is employed.

OBJECTS AND SUMMARY OF THE INVENTION

An object of the present invention is to provide an enhanced photoflash lamp. Another object of the invention is to prove an improved process for fabricating a photoflash lamp. Still another object of the invention is to provide an improved filament-type photoflash lamp having a reduced actinic light initiation time. A further object of the invention is to provide an improved filament-type photoflash lamp having a primer which includes a percussively-ignitable material responsive to heat generated by an activated filament.

These and other and further objects, advantages and capabilities are achieved in one aspect of the invention by a filament-type flashlamp having a combustible gas and shredded fill within an envelope wherein a pair of electrically conductive leads are interconnected by a filament and contiguous to a primer of percussively-ignitable material and powdered combustible incandescible material.

In another aspect of the invention, a filament-type photoflash lamp is fabricated by a process wherein a glass envelope is filled with a combustible shredded metal, electrical leads are sealed into the envelope and interconnected with a filament wire, a primer including percussively-ignitable and powdered combustible incandescible materials is affixed to the leads, and the envelope is exhausted and sealed.

BEST METHOD FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
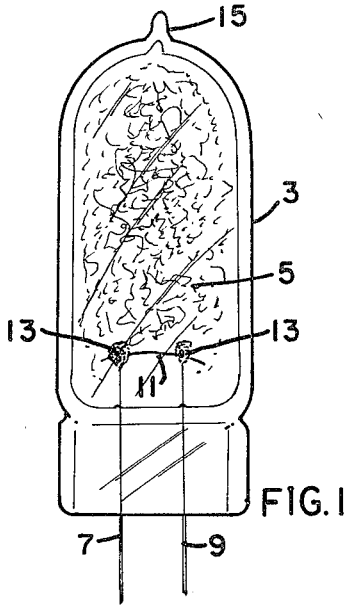
FIG. 1 is an elevational view, partly in sections, of a filamentary-type photoflash lamp utilizing the primer material of the invention.

Referring to FIG. 1 of the drawings, a filament-type photoflash lamp includes an envelope 3 containing a shredded combustible metal fill 5. The envelope 3 has a pair of electrically conductive leads 7 and 9 hermetically sealed therein and passing therethrough. The electrically conductive leads 7 and 9 are interconnected by a filament wire 11 interiorly of the envelope 3 and primer material 13 is affixed to each one of the leads 7 and 9. Moreover, the envelope has an exhaust tip 15.

More specifically, the envelope 3 is preferably a relatively hard glass of the borosilicate type having a length of about 1.10 inches, a diameter of about 0.306 mils, a wall thickness of about 0.033 mils with a volume of about 0.55 cubic centimeters. This envelope 3 is filled with about 22 mgs. of a shredded combustible metal, preferably zirconium, having a thickness of about 0.95 mil, a width of about 1.70 mil and a length of about 4.0 inches.

A filament wire 11 of tungsten interconnects the electrically conductive leads 7 and 9 and the primer material 13 is affixed thereto. This primer material 13 includes a precussively-ignited material and a powdered combustible incandescent material along with a suitable oxidizer and necessary stabilizers and binders. Preferably, the fuel or percussively-ignitable material is a red phosphorous while the powdered combustible incandescent material is in the form of powdered zirconium.

In conjunction with the fuel, a preferred oxidizer is sodium perchlorate ($NaClO_4$) although all chlorates and perchlorates of alkali and alkaline earth metals may be substituted for the sodium perchlorate. Moreover, a water-based stabilizer and binder system is preferred and a stabilizer such as lomar D available from The Diamond Shamrock Chemical Company of Morristown, New Jersey, in conjunction with small amounts of magnesium oxide are suitable to the previously-listed ingredients.

As an example, a likely composition may be selected from the following:

| | |
|---|---|
| Red Phosphorous | 10–50% by dry weight |
| Zirconium Powder | 50–85% by dry weight |
| Stabilizers & Binders | 2–6% by dry weight |

As an example of a preferred compositon but in no way limiting thereto, the following materials and quantities were selected:

| | |
|---|---|
| Red Phosphorous | 10.00% by dry weight |
| Zirconium (1–3 μm) | 86.25% by dry weight |
| Stabilizers & Binders | 3.75% by dry weight |

Moreover, a suitable oxidizer for the above-listed ingredients is a saturated solution of sodium perchlorate ($NaClO_4$).

Figure 2:
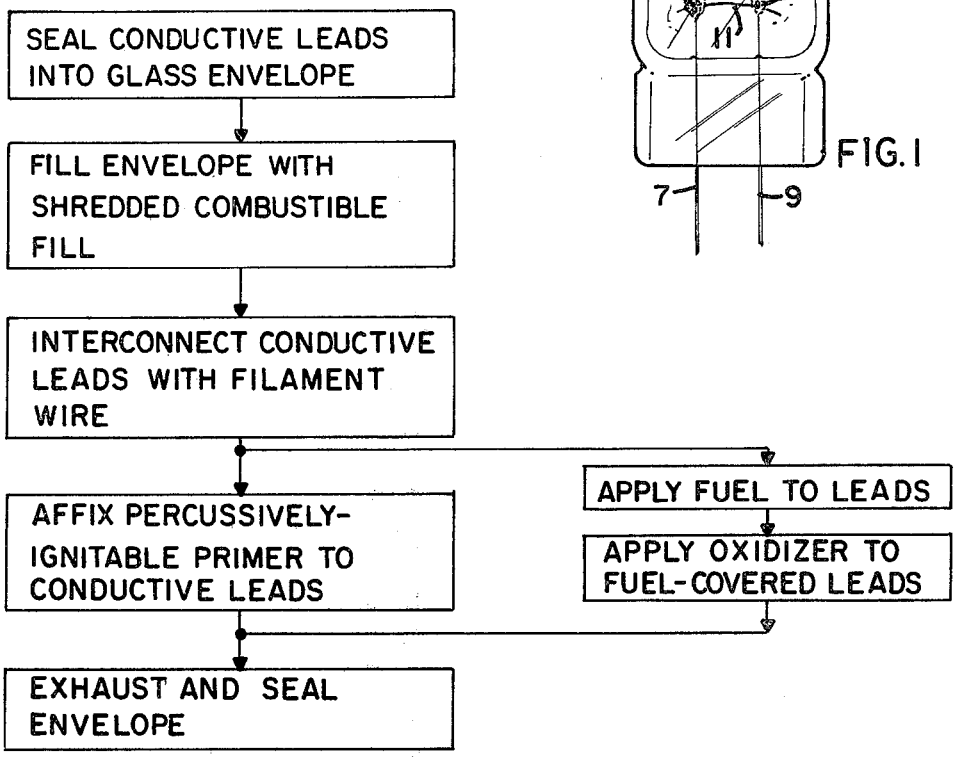
FIG. 2 is a chart illustrating the fabrication of the flashlamp of FIG. 1.

In fabricating a filament-type photoflash lamp as illustrated in FIG. 2, a pair of electrically conductive leads are sealed into a glass envelope and the envelope is filled with about 22 mg. of a shredded combustible metal such as zirconium. Then, a tungsten filament wire is connected to the pair of electrically conductive leads interiorly of the envelope.

Thereafter, the primer of percussively-ignitable material is affixed to the electrically conductive leads. Because of the sensitivity of such primer materials, it is preferred to first provide a mixture of the fuels or percussively-ignitable and powdered combustible incandescible materials such as the red phosphorous and zirconium powder. This mixture is applied to the electrically conductive leads and dried thereon. Then, the primered electrically conductive leads are dipped into a saturated solution of oxidizer such as a saturated solution of sodium perchlorate ($NaClO_4$). Again, the fuel mixture dipped into the oxider is allowed to dry.

Following, the envelope containing the dried fuel mixture impregnated with oxidizer is exhausted and filled with pure oxygen to a pressure of about 925 cm of Hg or about 12 atmospheres. This exhausted envelope is then sealed by way of an exhaust tip to provide an enhanced filamentary-type photoflash lamp responsive to a relatively low voltage source.

In comparison tests with filament-type lamps utilizing primer materials of the non-percussive type and a relatively low voltage source, it was found that photoflash lamps with a percussively-ignitable primer material provide a dark time in the range of about 1.0 to 1.5 msecs. faster than those with a non-percussive primer material. In other words, tests on the above-detailed primer materials provided a dark time in the range of about 2.0 to 2.5 msecs. while the non-percussive primer materials utilizing the same envelope exhibited a dark time of about 3.0 to 3.5 msecs. Moreover, the peak lighting times in both instances tracked the dark time periods.

While there has been shown and described what is at present considered the preferred embodiments of the invention, it will be obvious to those skilled in the art that various changes and modifications may be made therein without departing from the invention as defined by the appended claims.

INDUSTRIAL APPLICABILITY

Thus, there has been provided an enhanced filament-type photoflash lamp suitable for use with a camera having a relatively low voltage high current power source. The lamp includes a primer responsive to the above-mentioned power source for providing a flashlamp actinic output having a relatively short dark time period. This dark time period, defined as the time intermediate the application of power and the initiation of actinic output from the flashlamp, is reduced as compared with other known filamentary-type flashlamps suitable for use with a relatively low voltage source.

Also, a photoflash fabricating process provides a unique technique for fabricating the above-described photoflash lamp. The process steps not only provide an economical utilization of labor and apparatus but also greatly enhance the safety of the assembly operation. Moreover, this added safety capability extends to both equipment and personnel utilized in the operation.

I claim:

1. A filament-type photoflash lamp having a combustion-supporting gas and shredded metal fill contained within a glass envelope with a pair of electrically conductive leads hermetically sealed to and passing through said envelope and interconnected by a filament wire interiorly of the envelope, the improvement comprising a primer including a percussively-ignitable material and a powdered combustible incandescible material disposed within said envelope and responsive to heat generated upon energization of said filament wire to effect activation thereof and of said shredded metal fill whereby the time for initiating actinic light production is reduced.

2. The filament-type photoflash lamp of claim 1 wherein said primer includes a mixture of a percussively-ignitable fuel and an oxidizer.

3. The filament-type photoflash lamp of claim 1 wherein said percussively-ignitable and powdered combustible incandescible materials include red phosphorous and zirconium.

4. The filament-type photoflash lamp of claim 1 wherein said primer includes an oxidizer for said percussively-ignitable and powdered incandescible materials.

5. The filament-type photoflash lamp of claim 1 wherein said primer includes an oxidizer in the form of sodium perchlorate.

6. The filament-type photoflash lamp of claim 1 wherein said primer includes an oxidizer selected from the group of chlorates and perchlorates of alkali and alkaline earth metals.

7. The filament-type photoflash lamp of claim 1 wherein the time between said energization of said filament wire and initiation of said activation of said shredded metal fill is in the range of about 2.0 to 2.5 msecs.

8. The filament-type photoflash lamp of claim 1 wherein said percussively-ignitable material is in the range of about 10% to 50% by dry weight and said powdered incandescible combustible material is in the range of about 50% to 85% by dry weight.

9. The filament-type photoflash lamp of claim 1 wherein said primer includes about 86.25% dry weight zirconium powder, 10.0% dry weight red phosphorous and about 3.75% dry weight stabilizers and binders.

10. A primer material for a filamentary-type photoflash lamp responsive to a relatively low wattage high current power source comprising a fuel including a persuasively-ignitable material and a powdered combustible incandescible material in the form of zirconium powder and an oxidizer disposed within said photoflash lamp and contiguous to a filament therein.

11. The primer material of claim 10 wherein said percussively-ignitable material of said fuel is in the form of red phosphorous.

12. The primer material of claim 10 wherein said powdered combustible incandescible material of said fuel is in the form of zirconium powder.

13. The primer material of claim 10 wherein said percussively-ignitable material is in the range of about 10% to 50% dry weight, said powdered incandescible combustible material is in the range of about 50% to 85% dry weight and said primer includes about 2% to 6% binders and fillers.

14. The primer material of claim 10 wherein said primer includes about 86.25% dry weight of zirconium powder, 10.0% dry weight red phosphorous and about 3.75% dry weight stabilizers and binders.

* * * * *